United States Patent [19]

Greasley et al.

[11] Patent Number: 4,702,183

[45] Date of Patent: Oct. 27, 1987

[54] LOCKSTITCH SEWING MACHINE

[75] Inventors: Michael J. Greasley, Countesthorpe; Richard J. Manning, Tugby, both of Great Britain

[73] Assignee: Standard Machinery Limited, Leicester, England

[21] Appl. No.: 892,190

[22] Filed: Jul. 31, 1986

[30] Foreign Application Priority Data

Jul. 31, 1985 [GB] United Kingdom ..... 8519330
Dec. 17, 1985 [GB] United Kingdom ..... 8531004

[51] Int. Cl.[4] ..... D05B 15/04; D05B 57/14; D05B 69/14

[52] U.S. Cl. ..... 112/38; 112/190; 112/232

[58] Field of Search ..... 112/38, 182, 189, 190, 112/191, 230, 232, 36, 54, 164

[56] References Cited

U.S. PATENT DOCUMENTS 837,283 12/1906 Corcoran ..... 112/190
1,093,239 4/1914 Ballard ..... 112/189
1,302,219 4/1919 Reece ..... 112/190
3,246,619 4/1966 Kawaguchi ..... 112/190 X
4,488,499 12/1984 Giaimo et al. ..... 112/230

FOREIGN PATENT DOCUMENTS 83578 10/1895 Fed. Rep. of Germany .
84517 12/1895 Fed. Rep. of Germany .
462177 7/1928 Fed. Rep. of Germany .

*Primary Examiner*—Wm. Carter Reynolds
*Attorney, Agent, or Firm*—Gottlieb, Rackman & Reisman

[57] ABSTRACT

A lockstitch sewing machine, particularly for use as an insole stitcher, having a stitching mechanism arranged for cyclically repeating operation and including a horizontally mounted rotary shuttle, has the shuttle arranged for rotation in a constant direction at a cyclically varying angular velocity such that a major part of each rotation, e.g., a complete rotation takes place in a minor part of each cycle, e.g., one quarter of the cycle. The rotation of the shuttle is provided, e.g., by a Geneva cam.

8 Claims, 5 Drawing Figures

FIG. 4.
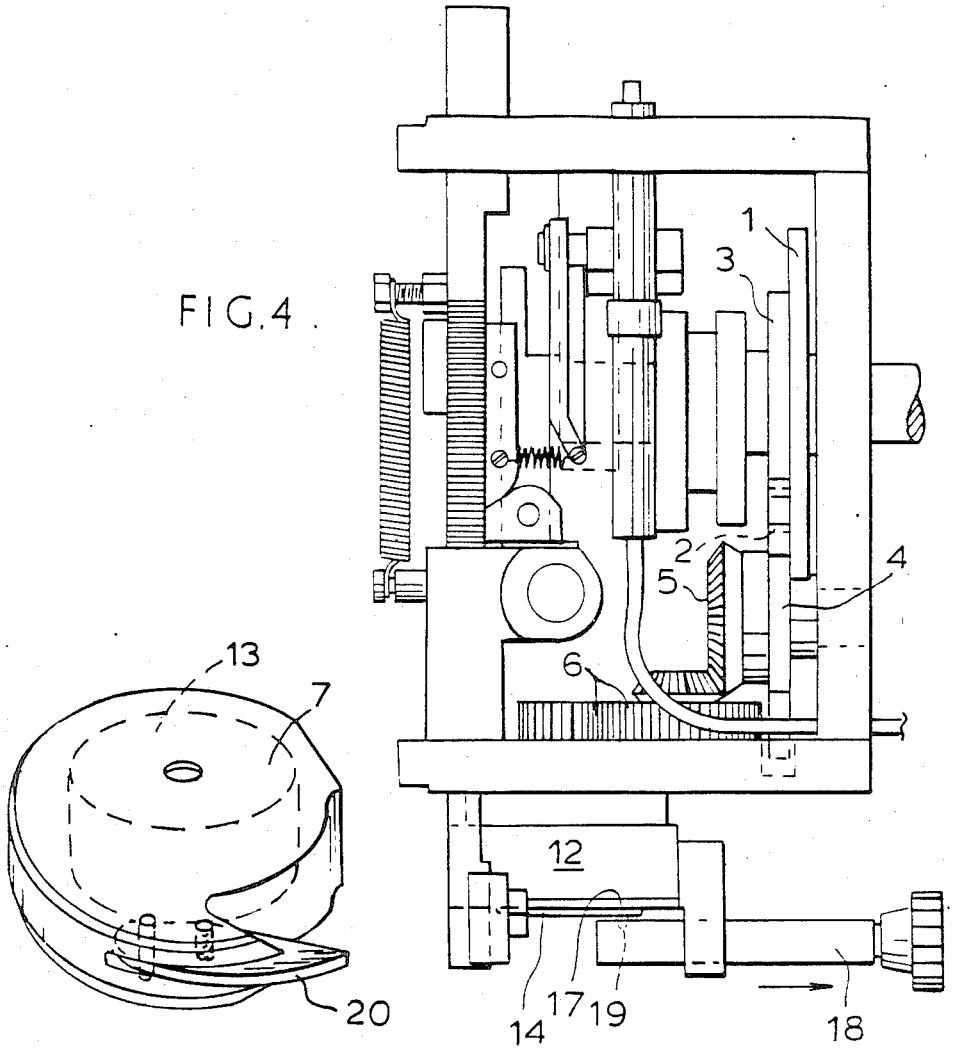
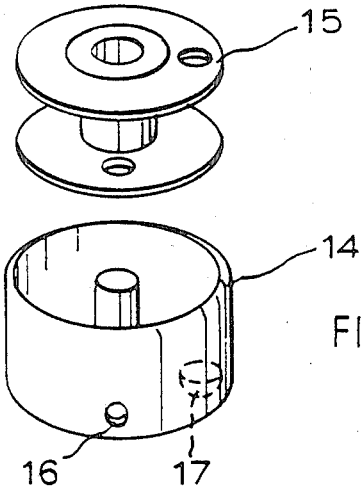
FIG. 5.

LOCKSTITCH SEWING MACHINE

The present invention relates to a lockstitch sewing machine, particularly the smaller type used by shoe repairers for insole stitching.

Lockstitch sewing machines used in the shoe repair business generally comprise a horizontally mounted circular shuttle which reciprocates about a vertical axis. A conventional shuttle of this type is generally disk-shaped with a central well for the thread bobbin and a circumferentially oriented shuttle point. Reciprocal rotary motion is provided by a shuttle driver which interlocks with the shuttle and is in turn provided with reciprocal rotary motion by suitable cam and drive means. The shuttle driver is conventionally fitted with a circumferentially extending point known as the splitter.

In conventional operation a cycle starts with the needle in the raised position and the shuttle rotating in a first direction, for example clockwise (viewed from above). The needle descends, picks up a loop of thread in the horn of the sewing machine and returns to its raised position. At this point, the splitter parts the loop of thread below the needle, and diverts it into the path of the shuttle point. The direction of rotation of the shuttle is then reversed and the point of the shuttle (which opposes the splitter) passes through the loop. Conventionally, at this point, a small lifting arm mounted on the shuttle drive lifts the loop clear of the needle barb. Further rotation of the shuttle then pushes the loop of thread over the shuttle, thus trapping the shuttle thread. Tension is then applied to the horn thread and the new stitch is pulled down tight onto the workpiece. The needle then finishes its descent and the cycle is repeated.

Machines of this type are to be contrasted with the lockstitch sewing machines used as outsole stitchers in the shoe making industry. These are much larger, expensive, heavy duty machines which, apart from other differences, are constructed to allow welts to be stitched in close to the waist of the shoe. In machines of this type, the shuttle is mounted verticlly and rotates in a constant direction at a constant or cyclically varying speed. They are fitted with a curved needle and a loop-taker or lifter to place the loop of thread onto the needle. They are also constructed for high speed action. A machine of this type is disclosed in GB No. 746389.

In contrast, the present invention is concerned with the relatively inexpensive, simpler slower machines used in repair shops etc., which conventionally use a reciprocating horizontal shuttle. These machines only have a straight needle, and therefore have no loop taker or lifter, since the loop will slide down the needle without extra guidance. However, they do need a splitter to enable the loop to pass over the shuttle point.

In addition, reciprocal rotary motion is always a problem in engineering terms. Power from the drive shaft from the primary power source is always rotary and in order to provide reciprocal motion this rotary power has to be translated via sliding rack and pinion systems which are inevitably cumbersome and potentially limiting on the speed of operation of the machine. We have now devised a simplified shuttle mechanism in a lockstitch machine in which the shuttle is provided with intermittent rotation in a constant direction, so that no reciprocal action is required. By modifying the shape of the shuttle point, it becomes possible to obtain a more precise action.

According to the present invention there is provided a lockstitch sewing machine for use as an insole stitcher, having a stitching mechanism arranged for cyclically repeating operation and including a horizontally mounted rotary shuttle, characterised in that drive means are provided for the shuttle for effecting an intermittent rotation of the shuttle in a constant direction at a cyclically varying angular velocity, such that a major part of each rotation takes place in a minor part of each cycle.

Because the single movement of the shuttle achieves the threading of the loop onto the shuttle point and over the shuttle thread in one simple movement, the actual duration of rotary movement can comprise a relatively small proportion of the total stitching cycle. The cyclic variation in the angular velocity is therefore preferably one in which the rotation is effectively intermittent. In essence, the cycle is achieved so that as the needle plus loop of thread reaches its raised position, the shuttle is given a rapid rotation through one whole revolution (360°) during, say, one quarter of the cycle and then remains stationary for the remaining three quarters.

The shuttle drive is therefore required to provide one rapid revolution intermittently and in a constant direction. We find that this can be easily and conveniently achieved by use of suitable control elements in the drive means for the shuttle, e.g., a multi-slotted cam of the type known as a Geneva cam or Geneva wheel. A cam of this type generally comprises a pair of interacting cams. The first is a generally circular cam wheel with abrupt, radially extending slots and re-entrant curved portions between the mouths of the slots. The second component comprises a wheel carrying a peripherally mounted cam roller arranged to follow the profile of the first component and a centrally mounted cam arranged to follow the exterior profile of the first component (i.e. excluding the slots). As the second component rotates, the central cam moves on the profile of the first component causing no rotary motion thereof. As the cam wheel interlocks with a slot of the first component, however, the first component is given rotary movement. Considering the case where there are four slots, the slots are formed of suitable depth so that the rotary movement is through 90°, at which point the cam wheel leaves the slot. Thus, each single rotation of the second component causes the first component to move abruptly through 90°. A suitable 4:1 gearing can convert the intermittent 90° rotary movement into intermittent 360° movement. Obviously a different number of slots of different depth would give a different angle of rotation, which in turn would require different gearing.

The use of a Geneva cam system of this type is preferred because the rotary movement imparted to the slotted wheel, and hence to the shuttle, is relatively abrupt, but is progressive without being jerky. The Geneva cam system can be designed so that the rotary movement has a very short acceleration and deceleration phase at each end of the 90° throw. Other intermittent or varying angular velocity cyclic drive systems are possible, but may not have this advantage of smooth acceleration/deceleration. Examples involve the use of eccentric or quandrant gears, and eccentric drives with drag link connections.

A preferred embodiment of the machine according to the present invention is adapted to overcome two problems which can arise in the operation of a non-reciprocating shuttle. A conventional shuttle, as used in lockstitch insole sewing machines, comprises a generally cylindrical disc-shaped container having a central cavity to accommodate the bobbin interconnecting with a slot leading from the shuttle point. Normally, the shuttle has to be removed from the machine while the bobbin is inserted and the yarn then has to be threaded through an intricate and time-wasting operation before the shuttle is replaced. The bobbin is fixed to the shuttle and thus reciprocates with it. If a shuttle of this type is used for intermittent rotation in a constant direction, the thread is constantly twisted in the same direction and thus becomes wound up and kinked, or unwound and unravelled, depending on the direction of twist.

In a preferred embodiment of the invention the machine is fitted with a modified shuttle in which the bobbin cavity is on the underside and is adapted to house a bobbin in a bobbin case which is fixedly located relative to the machine and does not rotate with the shuttle. Preferably, the bobbin case is fixed by a simple spring-biassed pinch device so that it can be simply released and allowed to drop out of the shuttle, which stays in situ. Rotation of the bobbin is prevented by provision on the case of a simple location peg or cavity arranged to cooperate with a corresponding cavity or peg on the mounting. Using a shuttle system of this type, we find that loading the shuttle is much easier and that the thread is neither kinked nor unravelled.

In a further preferred embodiment, the shuttle itself is provided with an adjustable blade or point at the shuttle point so that an exact alignment of the shuttle and the thread loop can be achieved.

Two embodiments of the invention will now be described with reference to the accompanying drawings in which:

FIG. 4 is a partial side view of a headbox fitted with a shuttle having a non-rotating bobbin case; and FIG. 5 is an exploded view of the shuttle and bobbin case of the embodiment of FIG. 4.

Figure 1:
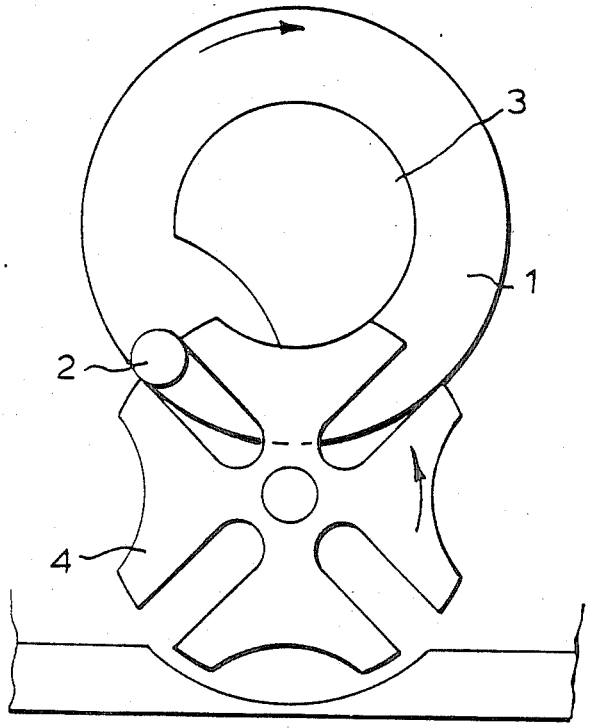
FIG. 1 is a schematic view of a Geneva cam.
Figure 2:
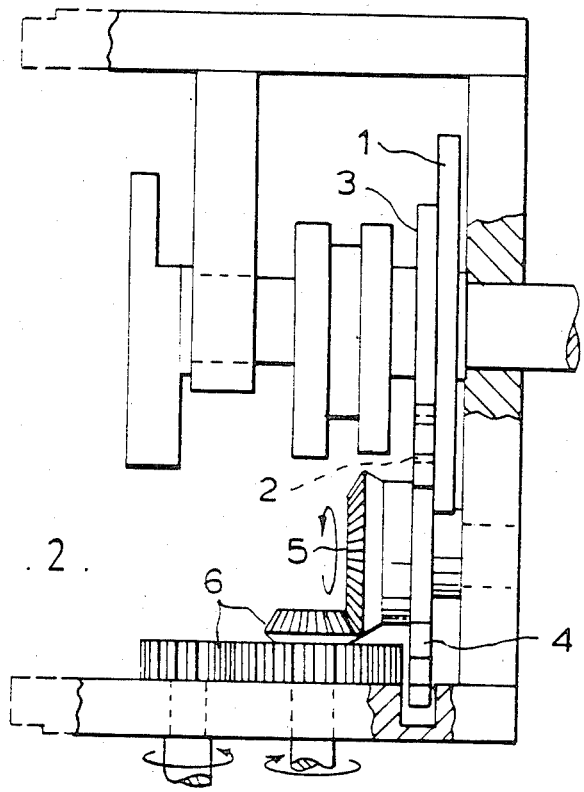
FIG. 2 is a schematic representation of the gearing linking the cam to the shuttle drive.

Referring first to FIGS. 1 and 2, the shuttle drive for an insole lockstitch sewing machine comprises a Geneva cam comprising a round wheel 1 carrying a cam roller 2 and a central cam 3, and a slotted wheel 4 bearing against the central cam 3. The slotted wheel 4 has mounted thereon a bevel gear 5 arranged to drive gears 6 with a ratio such that a 90° turn of the slotted wheel 4 provides a 360° turn of the final gear driving the shuttle 7 (FIG. 3).

The Geneva cam is arranged to be driven such that when the needle bar 10 is in its raised position carrying a loop of thread 11, the shuttle 7 is given an essentially instantaneous 360° rotation so that the shuttle point 20 splits the loop 11 which slips off the needle and passes over the shuttle thus forming a stitch.

Figure 3:
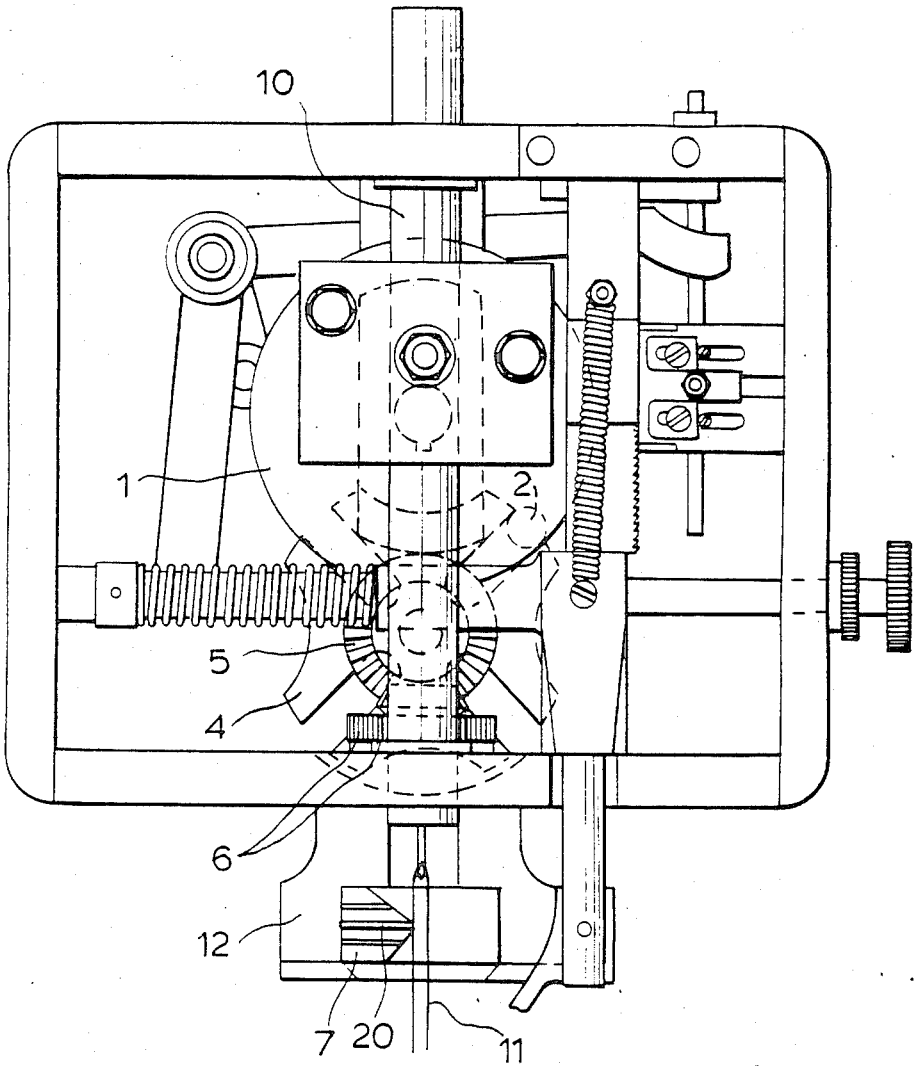
FIG. 3 is a front elevation of the headbox of an insole stitching machine with the front panel removed and the shuttle drive illustrated.

In the embodiment of FIGS. 3 and 4, the shuttle 7 is fixedly located inside a shuttle housing 12. The shuttle 7 is formed with a cylindrical cavity 13 (broken lines in FIG. 5) in its base into which a bobbin case 14 can be inserted from below. The bobbin case 14 is open at the top to contain a bobbin 15 and has a thread hole 16 and a location peg 17. Adjacent to the shuttle housing 12 is provided a spring-biassed plunger 18 (FIG. 4) having a small indentation 19 arranged to receive the peg 17. To release the bobbin case 14, the plunger 18 is pulled rearwardly (to the right in FIG. 4) and the bobbin case can drop out of the cavity 13 in the shuttle 7. As the shuttle is rotated, the thread is allowed to slip between the peg 17 and the indentation 19. In one embodiment the shuttle 7 is fitted with a screw-adjustable blade or point 20 to permit accurate alignment with the loop of thread 11 in the needle.

We claim:

1. In a lockstitch sewing machine, particularly for use as an insole stitcher, having a stitching mechanism arranged for cyclically repeating operation and including a horizontally mounted rotary shuttle, the improvement comprising means for driving the shuttle for intermittent rotation in a constant direction at a cyclically varying angular velocity, said means including control elements operable to enable a complete shuttle rotation to be achieved during one quarter of each cycle and to have the shuttle remain stationary during the remaining three quarters of each cycle.

2. The lockstitch sewing machine of claim 1 in which said control elements comprise a Geneva cam.

3. The lockstitch sewing machine of claim 1 in which the shuttle has a bobbin cavity in the underside thereof and is adapted to house a bobbin in a bobbin case, said bobbin case and said shuttle including cooperative means for fixedly locating said said bobbin case relative to the machine and inhibiting rotation of said bobbin case with the shuttle.

4. The lockstitch sewing machine of claim 1, said shuttle further having an adjustable blade or point at the shuttle point.

5. In a lockstitch sewing machine, particularly for use as an insole stitcher, having a stitching mechanism arranged for cyclically repeating operation and including a horizontally mounted rotary shuttle, the improvement comprising means for driving the shuttle for intermittent rotation in a constant direction at a cyclically varying angular velocity, said means including a Geneva cam constructed and arranged such that a major part of each rotation takes place in a minor part of each cycle.

6. The lockstitch sewing machine of claim 5 in which said Geneva cam is constructed and arranged such that a complete shuttle rotation is achieved during one quarter of each cycle and that the shuttle remains stationary during the remaining three quarters of each cycle.

7. The lockstitch sewing machine of claim 5 in which the shuttle has a bobbin cavity in the underside thereof and is adapted to house a bobbin a bobbin case, said bobbin case and said shuttle including cooperative means for fixedly locating said bobbin case relative to the machine and inhibiting rotation of said bobbin case with the shuttle.

8. The lockstitch sewing machine of claim 5 in which the shuttle further has an adjustable blade or point at the shuttle point.

* * * * *